US006449999B1

(12) United States Patent
Paraskevas

(10) Patent No.: US 6,449,999 B1
(45) Date of Patent: Sep. 17, 2002

(54) DEVICE FOR FEEDING THE FRONT END OF A WIRE COIL INTO A DRAWING INSTALLATION

(75) Inventor: Elefterios Paraskevas, Aachen (DE)

(73) Assignee: EJP Maschinen GmbH, Düren (DE)

( * ) Notice: Subject to any disclaimer, the term of this patent is extended or adjusted under 35 U.S.C. 154(b) by 0 days.

(21) Appl. No.: 09/673,444

(22) PCT Filed: Apr. 15, 1999

(86) PCT No.: PCT/DE99/01123

§ 371 (c)(1),
(2), (4) Date: Oct. 16, 2000

(87) PCT Pub. No.: WO99/54069

PCT Pub. Date: Oct. 28, 1999

(30) Foreign Application Priority Data

Apr. 17, 1998 (DE) ..... 198 17 100

(51) Int. Cl.[7] ..... B21C 47/34

(52) U.S. Cl. ..... 72/161; 72/183; 72/274; 242/566; 242/128

(58) Field of Search ..... 72/280, 278, 287, 72/274, 183, 161, 289, 160; 140/147; 242/566, 157 R, 171, 615.4, 615, 128

(56) References Cited

U.S. PATENT DOCUMENTS 3,282,304 A * 11/1966 Coleman ..... 242/566
3,536,274 A * 10/1970 Tommarello ..... 72/287
4,926,668 A * 5/1990 Rau ..... 72/289

FOREIGN PATENT DOCUMENTS

| | | | |
|---|---|---|---|
| DE | 41927 | 7/1964 | |
| DE | 29506994 | 8/1995 | |
| DE | 19613686 | 10/1996 | |
| GB | 2078583 | * 1/1982 | ..... 72/289 |
| JP | 2099219 | 11/1988 | |
| JP | 4133968 | 7/1992 | |

* cited by examiner

*Primary Examiner*—Daniel C. Crane
(74) *Attorney, Agent, or Firm*—Selitto, Behr & Kim

(57) ABSTRACT

The aim of the invention is to reduce the amount of space and the technical effort required to feed the front end of a wire coil into a wire drawing installation. To achieve this, the arm of the device is formed from a base section and an end section, whereby the end of the base section can pivot around a first pivotal axis and is connected to the base of a rotationally mounted holder and the pivotal axis of the base section runs perpendicular to the axis of rotation of said holder. One end of the end section can pivot around a second pivotal axis and is connected to the other end of the base section. The first and second pivotal axes run parallel to each other. The free end of the end section of the arm supports a head unit that is rotationally mounted around two axes that are located in a normal position to each other. A hook-shaped gripping element and a clamping device which dresses the front end of the wire coil are arranged on said head unit. Control units for swinging or rotating the holder, arm sections and head unit are provided.

9 Claims, 3 Drawing Sheets

DEVICE FOR FEEDING THE FRONT END OF A WIRE COIL INTO A DRAWING INSTALLATION

Figure 1:
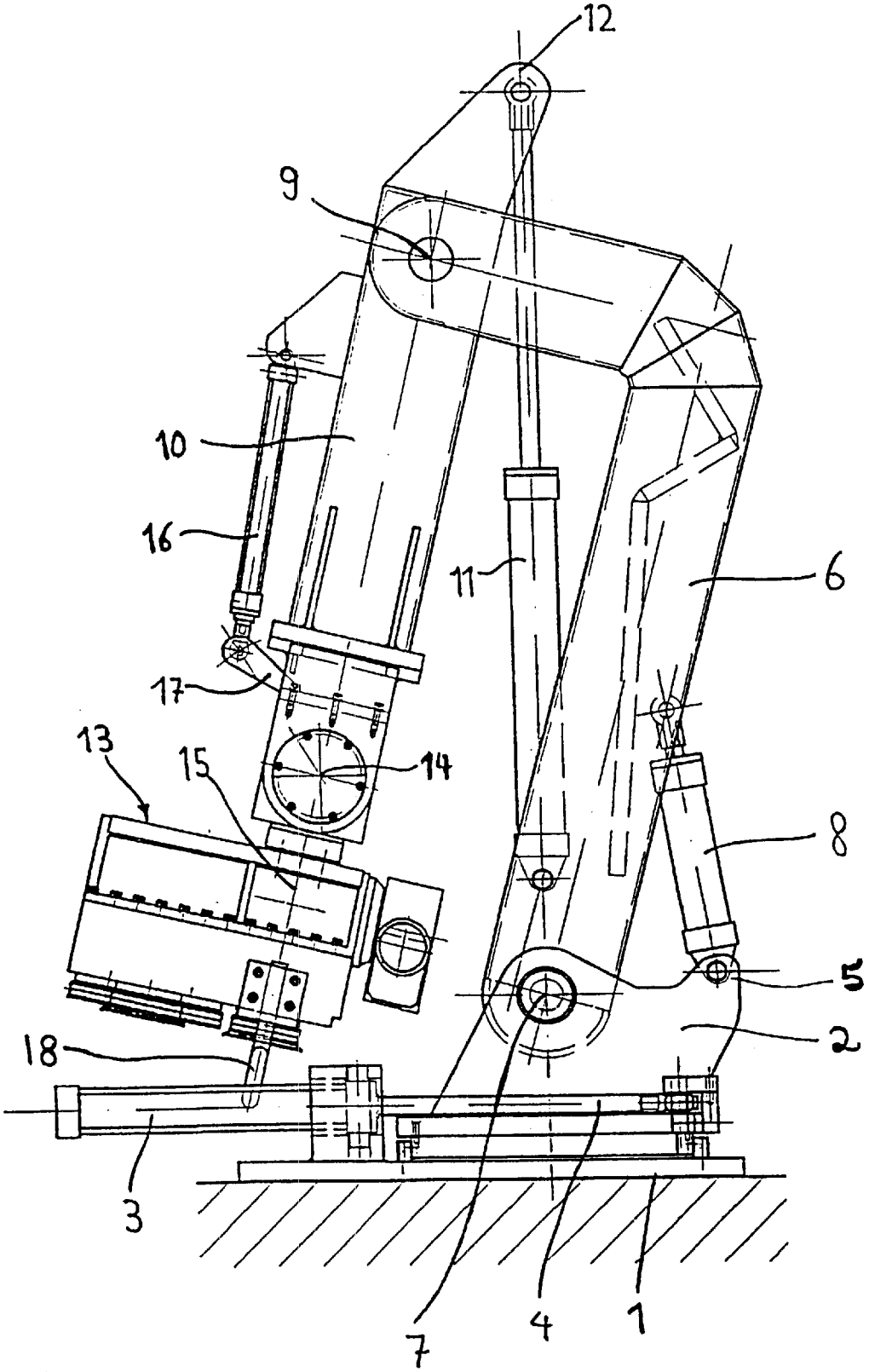

This application is a 371 of PCT/DE99/01123, filed Apr. 15, 1999.

The invention relates to a device for feeding the front end of a wire coil to a drawing installation, having a base, on which a holder is rotatably mounted, and an arm, which is connected to the holder and at its end has a gripper element for taking hold of the front end of the wire coil.

A device of this type which is known from DD 41 927 has a holder on which a radially displacable arm is arranged, the height of which arm can be varied by means of a lifting cylinder. At its free end, the arm bears a gripper element. To take hold of the front end of a coil, the gripper element is moved into the desired position through rotation and lifting or lowering of the arm. Then, the front end of the wire, through pivoting of the arm, is fed via straightening rollers to a clamping vise which provides preliminary guidance for the material in the working direction. This is followed by the wire-drawing operation itself.

A device of this nature requires considerable amounts of space in order to allow the rotary movements required to take place. Furthermore, the gripper elements have to clamp the front end of the wire, and devices for straightening the wire additionally have to be provided in the installation.

The object of the present invention is therefore to provide a device of the type described in the introduction which considerably reduces both the amount of space required and the outlay on equipment compared to this prior art.

To achieve this object, according to the invention in a device of the type described in the introduction, the arm is formed from a base section and an end section, one end of the base section is connected to the holder, which is mounted rotatably on the base, in such a manner that the base section can pivot about a first pivot axis, the pivot axis of the base section running transversely with respect to the axis of rotation of the holder, one end of the end section is connected to the other end of the base section, in such a manner that it can pivot about a second pivot axis, the first and second pivot axes run parallel to one another, the end section of the arm, at its free end, bears a head unit which is mounted in such a manner that it can rotate about two axes running at right angles to one another and on which a hook-shaped gripper element and a clamping device which straightens the front end of the wire coil are arranged, and control units are provided for pivoting or rotating the holder, the arm sections and the head unit.

The fact that according to the invention the arm is divided into two sections mean that the space required is considerably reduced both in the working position and in the standby position. In addition, the clamping device in this case at the same time fulfills a straightening function. Consequently, compared to the prior art it is possible to dispense with a clamping device which is used only to feed the front end of the wire to a straightening unit. The device is particularly suitable for wire diameters of 10 mm and above.

The front end of the wire is introduced into a drawing machine by means of the device, but may also be fed to a pointing unit connected upstream of this machine.

Furthermore, according to the invention the gripper element is mounted on the head unit so as to be able to pivot in a controlled manner. In this way, it is possible to take hold of the wire element and introduce it into the clamping device.

Furthermore, according to the invention the control units are hydraulic or pneumatic units.

Furthermore, according to the invention the clamping device is formed from two rows of pressure-exerting rollers which guide the wire between them and prestraighten it.

Furthermore, according to the invention the rows of pressure-exerting rollers are mounted in such a way that they can be adjusted relative to one another.

Furthermore, according to the invention individual pressure-exerting rollers in one row are mounted in such a manner that they can be adjusted relative to pressure-exerting rollers in the other row.

Furthermore, according to the invention at least two pressure-exerting rollers which are arranged opposite one another are connected to a rotary drive.

Finally, according to the invention the direction of rotation of the rotary drive can be reversed. This makes it possible to operate two lines of wire-drawing machines with only one device according to the invention, in which case the device interacts with two coils which are each resting on a spool. In this case, the device is expediently positioned between the two lines.

Figure 2:
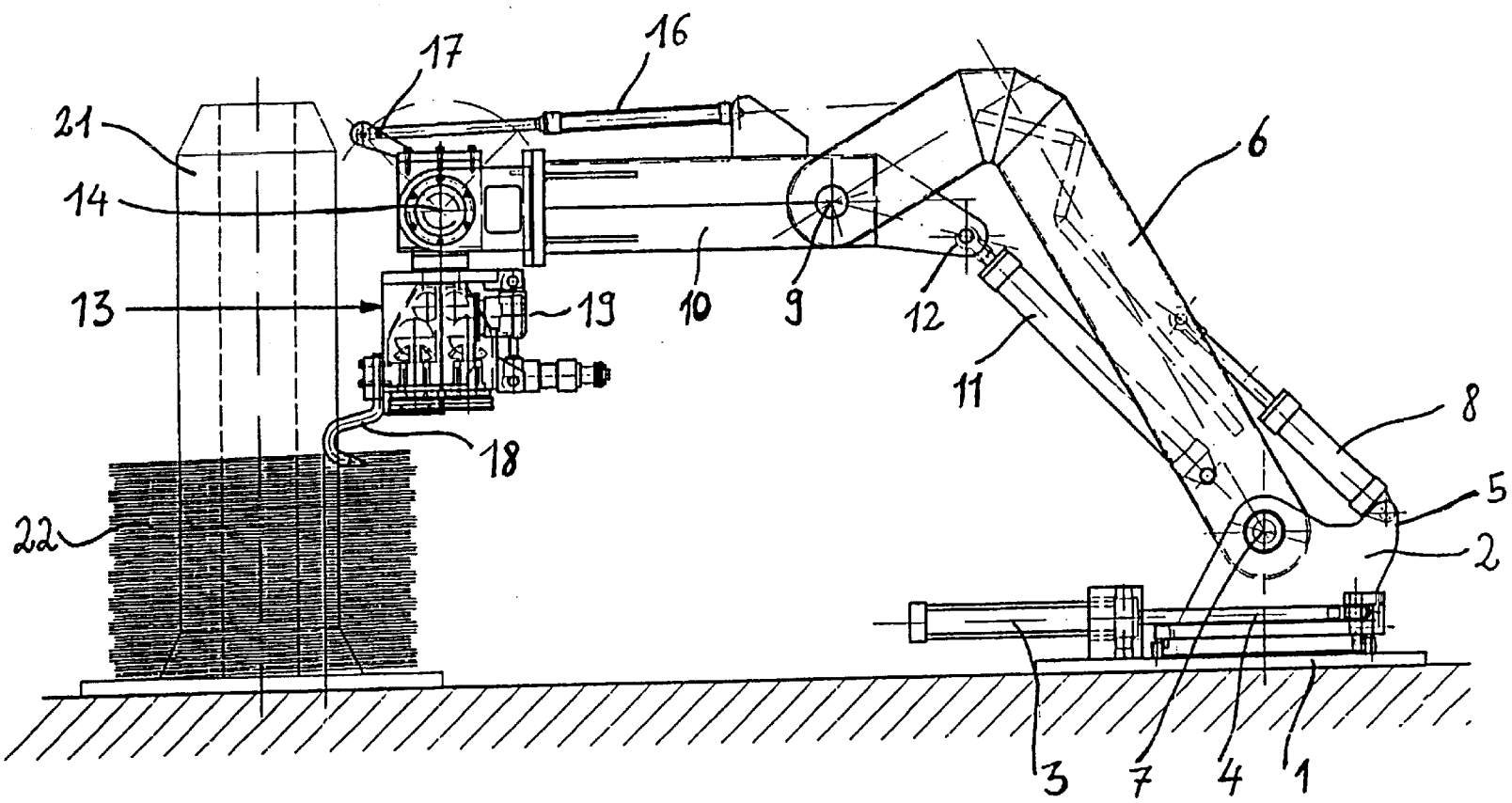
Figure 3:
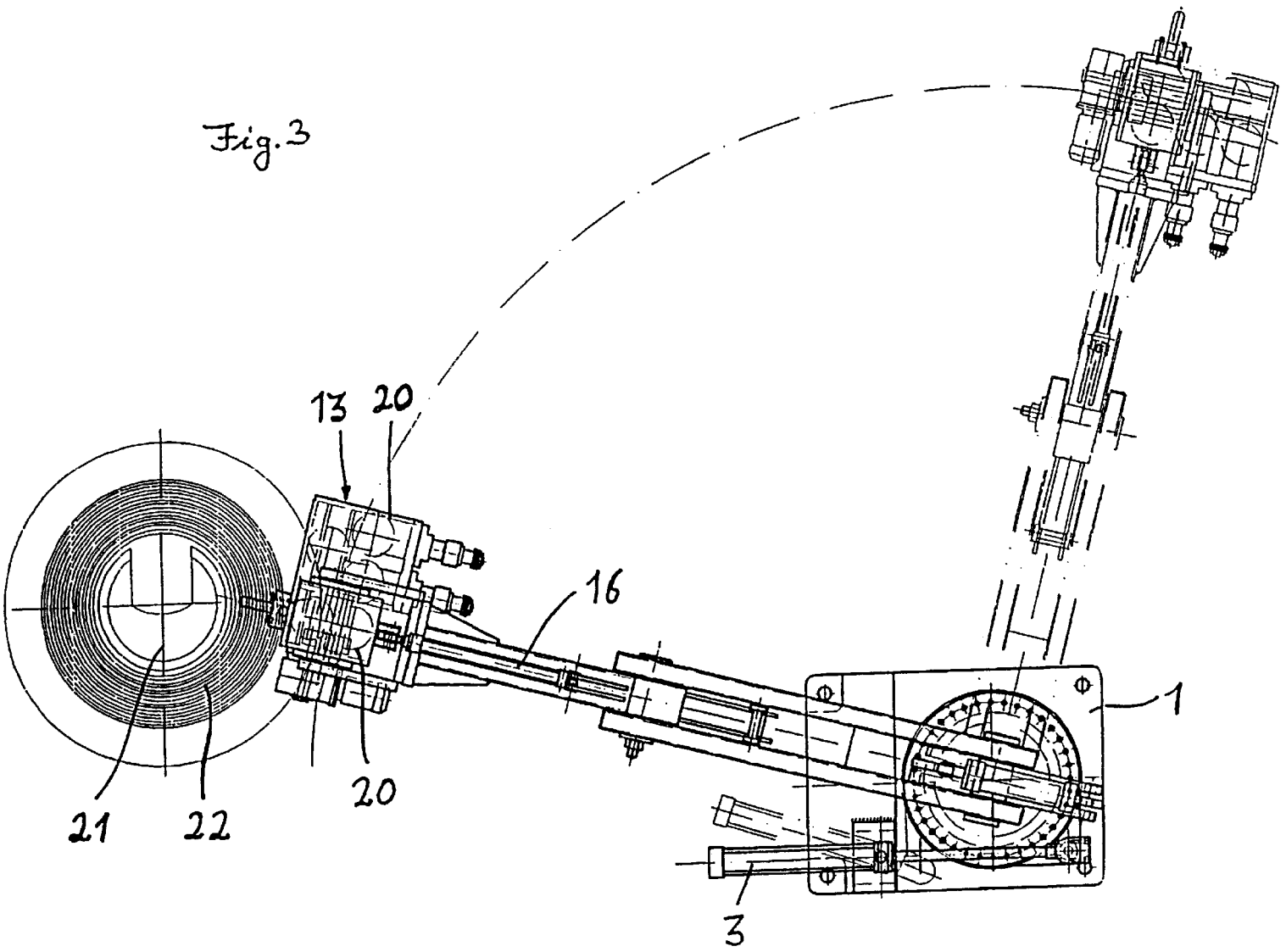

An embodiment of the device according to the invention is described below with reference to drawings, in which:

FIG. 1 shows a side view of an embodiment of the device in the standby position, FIG. 2 shows a side view of an embodiment of the device in the working position, and FIG. 3 shows a plan view of the device shown in FIGS. 1 and 2.

The device has a base 1, on which a holder 2 is rotatably mounted. A piston-cylinder unit 3 is pivotably fixed to the base 1. The piston 4 of the piston-cylinder unit 3 is articulatedly mounted on a projection 5 of the holder 2, so that a movement of the piston 4 leads to a rotation of the holder 2 with respect to the base 1. A base section 6 of an arm is connected to the holder 2 in such a manner that it can pivot about an axis 7. A piston-cylinder unit 8 is articulatedly mounted on the holder 2, at one end, and on the base section 6, at the other end.

The base section 6 is of substantially L-shaped design.

An end section 10 which runs substantially in a straight line is connected to the end of the base section 6 via an axis 9. A piston-cylinder unit 11 is articulatedly mounted on the base section 6, at one end, and on the end 12 of the end section 10 of the arm, at the other end.

The end section 10 bears a head unit 13 which can rotate both about the axis 14 and about the axis 15. These two axes run perpendicular to one another.

A piston-cylinder unit 16 is used to rotate the head unit 13 about the axis 14. One end of the piston-cylinder unit 16 is supported on the end section 10, while its other end is supported on a lever 17.

The head unit 13 bears a hook-shaped gripper element 18, the inclination of which with respect to the head unit 13 can be adjusted by means of a piston-cylinder unit 19.

Furthermore, the head unit 13 is provided with a clamping element in the form of pressure-exerting rollers 20 which are arranged in two opposite rows and between them receive and guide onward an end of a wire which is fed from the gripper element.

At least two opposite pressure-exerting rollers 20 are coupled to a rotary drive. The pressure-exerting rollers 20 are positioned and adjustable in such a way that they straighten the wire which is guided between them. The direction of rotation of the rotary drive can expediently be reversed.

If the front end of a coil is now to be fed to a wire-drawing machine, the arm formed from the base section 6 and the end section 10 is extended through actuation of the piston-cylinder units 8 and 11 in such a way that the hook-shaped gripper element 18, as a result of suitable rotations of the head unit 13, takes hold of the front end of a wire 30 coil 22 resting on a spool 21. The gripper element 18 is then displaced in such a way that the front end of the wire is introduced between the two rows of the pressure-exerting rollers 20 and is straightened and guided onward by these rollers. There then follows a rotation of the holder 2 into the position shown in dot-dashed lines in FIG. 3. In this case, the head unit 13 is positioned in such a way that the straightened wire end held therein is introduced into the entry to a wire-drawing machine or is transferred to a pointing unit of the wire-drawing installation. The device is then returned to the position illustrated in FIG. 1. The device can operate two lines of drawing machines starting from coils resting on separate spools.

LIST OF REFERENCES NUMERALS

1 Base
2 Holder
3 Piston-cylinder unit
4 Piston
5 Projection
6 Base section
7 Axis
8 Piston-cylinder unit
9 Axis
10 End section
11 Piston-cylinder unit
12 End of the end section
13 Head unit
14 Pivot axis
15 Pivot axis
16 Piston-cylinder unit
17 Lever
18 Gripper element
19 Piston-cylinder unit
20 Pressure-exerting rollers
21 Spool
22 Wire coil

What is claimed is:

1. A device useful in feeding a front end of a wire coil to a drawing installation, said device comprising:

a base;

an arm including a base section pivotable about a first axis and an end section pivotable about a second axis, said first axis being parallel to said second axis;

a holder rotatably mounted to said base, said holder being rotatable about a third axis which is transverse to said first and second axes, said holder being connected to said base section of said arm along one end of said base section, said end section having a free end and being connected to said base section of said arm along an opposite end of said base section; and a head unit connected to said free end of said end section of said arm, said head unit being rotatable about a fourth axis and about a fifth axis which is arranged at a right angle relative to said fourth axis, said head unit including a clamping device for straightening the front end of the wire coil.

2. The device of claim 1, further comprising controlling means for moving said holder, said base section of said arm, said end section of said arm, and said head unit.

3. The device of claim 2, wherein said controlling means is a plurality of hydraulic units.

4. The device of claim 2, wherein said controlling means is a plurality of pneumatic units.

5. The device of claim 1 or 2, wherein said clamping device includes a first row of pressure-exerting rollers and a second row of pressure-exerting rollers.

6. The device of claim 5, wherein said first row of pressure-exerting rollers is adjustable relative to said second row of pressure-exerting rollers.

7. The device of claim 5, wherein said pressure-exerting rollers of said first row are adjustable relative to said pressure-exerting rollers of said second row.

8. The device of claim 5, further comprising a rotary drive connected to a first row of pressure-exerting rollers and to a second row of pressure-exerting rollers.

9. The device of claim 8, wherein said rotary drive is sized and shaped to rotate in a first direction and in a reverse direction relative to said first direction.

* * * * *